US005954040A

United States Patent [19]

Riedel

[11] Patent Number: 5,954,040

[45] Date of Patent: Sep. 21, 1999

[54] METHOD AND ARRANGEMENT FOR CONTROLLING AN INTERNAL COMBUSTION ENGINE OF A VEHICLE

[75] Inventor: Karlheinz Riedel, Vaihingen, Germany

[73] Assignee: Robert Bosch GmbH, Stuttgart, Germany

[21] Appl. No.: 08/917,420

[22] Filed: Aug. 26, 1997

[51] Int. Cl.[6] ..... F02M 25/00

[52] U.S. Cl. ..... 123/703; 123/704; 123/494

[58] Field of Search ..... 123/703, 339.12, 123/406.44, 704, 494, 406.12

[56] References Cited

U.S. PATENT DOCUMENTS 5,261,270 11/1993 Gonze et al. ..... 123/494

*Primary Examiner*—John Kwon

*Attorney, Agent, or Firm*—Walter Ottesen

[57] ABSTRACT

The invention is directed to a method for controlling an internal combustion engine of a vehicle utilizing a control unit which detects operating data of the engine. The control unit includes a computing unit for processing the operating data and the control unit drives actuating elements for influencing the operating state of the engine in dependence upon the detected operating data. In the method, the concentration of at least one component of the ambient air is detected with a sensor and the concentration is processed in the control unit. The actuating elements are driven in dependence upon the at least one component of the ambient air. An arrangement for carrying out the method is also disclosed.

13 Claims, 1 Drawing Sheet

METHOD AND ARRANGEMENT FOR CONTROLLING AN INTERNAL COMBUSTION ENGINE OF A VEHICLE

FIELD OF THE INVENTION

The invention relates to a method for controlling an internal combustion engine of a vehicle with the aid of a control unit which performs the following: detects the operating data of the engine, processes the data in a control unit and, dependent upon the detected operating data, drives actuator elements for influencing the operating state of the engine.

BACKGROUND OF THE INVENTION

Methods of this kind have been known for some time. Accordingly, operating data are continuously detected in engine controls and are evaluated in control units and, in dependence upon the evaluated operating data, actuating elements are driven which, for example, change the injection time, the dwell angle or dwell time, the ignition time point, the pulse duty factor of the idle actuator and of the exhaust-gas return.

All known methods of this kind have in common that only the operating data of the engine are detected and evaluated and, in dependence upon these operating data, the actuating elements are driven. Such methods serve especially to provide an effective reduction of toxic emissions of the engine.

It is problematic in methods of this kind that the environmental influences are not considered. For example, the ozone values or even the values of carbon dioxide, nitrogen oxide, hydrocarbon, carbon monoxide or sulfur dioxide of the ambient are not considered in the control of the engine.

Most recently, bans on driving, speed limits and other limitations of motor vehicle traffic have been imposed or at least been taken into consideration because of ozone values in the ambient air which are too high. The ozone values of the ambient air have been detected via ozone sensors and evaluated and, in dependence upon the determined values, speed limits, bans on driving and the like have been issued. This requires additional technical as well as administrative effort. In this context, it has never been determined whether the corresponding prohibitions have even been observed by all operators of motor vehicles.

SUMMARY OF THE INVENTION

It is an object of the invention to provide a method for controlling an internal combustion engine of a vehicle which is so improved that ambient influences are considered in the control of the engine. It is another object of the invention to realize this method in the most simple technical manner possible.

The method of the invention is for controlling an internal combustion engine of a vehicle utilizing a control unit which detects operating data of the engine. The control unit includes a computing unit for processing the operating data and the control unit drives actuating element means for influencing the operating state of the engine in dependence upon the detected operating data. The method includes the steps of: detecting the concentration of at least one component of the ambient air with sensor means; processing the concentration in the control unit; and, driving the actuating element means in dependence upon the at least one component of the ambient air.

The method of the invention therefore includes the detection of the concentration of at least one component of the ambient air (and therefore in essence the detection of the composition of the ambient air), processing the detected data in the control unit and driving the actuating elements in dependence upon the detected concentration of the at least one component of the ambient air. This method affords the especially significant advantage that the control of the engine of a vehicle is possible in dependence upon environmental influences. The engine is therefore not only controlled in dependence upon the detected operating data thereof but, in an especially advantageous manner, also in dependence upon the concentration of the above-mentioned at least one component of the ambient air, that is, in dependence upon the ambient influences. It is understood that processing the detected ambient influences is carried out in parallel with and in combination with the processing of the operating data of the engine.

This presents the especially significant advantage that the engine (and therefore also the entire vehicle) is so driven by the control unit that the vehicle can be operated in a manner more compatible with the environment.

Basically, the most different sensors can be considered for detecting the concentration of at least one component of the ambient air.

Preferably, the sensors for detecting the concentration of at least one component of the ambient air include ozone sensors, carbon dioxide sensors, nitrogen oxide sensors, hydrocarbon sensors, carbon monoxide sensors or sulfur dioxide sensors because the motor vehicles themselves generate carbon dioxide, nitrogen oxide, hydrocarbons, sulfur dioxide as well as carbon monoxide and contribute to increased ozone concentration during operation, especially in high ambient temperatures.

The operating data of the engine, which are processed together with the detected and above-mentioned ambient influences, are especially the following: inducted air quantity and/or the temperature of the engine and/or the exhaust-gas composition and/or the temperature of the inducted air.

Advantageously, the actuating elements influence the following: the ignition time point and/or the injection time and/or the dwell time and/or the pulse duty factor of the idle actuator and the exhaust-gas return and/or the rpm of the engine and/or the speed of the vehicle and/or the lambda control. In this way, influence can be had on the entire vehicle in a most simple manner. For example, the speed can be reduced or the vehicle can be operated at a different operating point which is more compatible with the environment. It is here especially advantageous that all actuating elements for controlling the engine in dependence upon the operating data thereof are already available so that additional devices are not needed.

The arrangement of the invention is for controlling an internal combustion engine and includes: a plurality of sensors for detecting operating data of the engine; a control unit for processing and evaluating the operating data; actuating element means connected to the control unit and being provided to influence the operating state of the engine; ancillary sensor means for detecting at least one component of the ambient air; the ancillary sensor means being coupled to the control unit; and, the control unit being adapted to drive the actuating element means in dependence upon the data of the ancillary sensor means.

Preferably, one or more of the following sensors can be coupled to the control unit: ozone sensors and/or carbon dioxide sensors and/or nitrogen oxide sensors and/or hydrocarbon sensors and/or carbon monoxide sensors and/or sulfur dioxide sensors.

The control unit is advantageously part of an engine control known per se which includes at least input converters, output end stages, an input/output unit, a central computing unit, a read-only memory (ROM) and a read/write memory (RAM).

BRIEF DESCRIPTION OF THE DRAWING

The invention will now be described with respect to the single figure (FIG. 1) of the drawing which shows an arrangement according to the invention for controlling an internal combustion engine of a vehicle.

DESCRIPTION OF THE PREFERRED EMBODIMENTS OF THE INVENTION

Figure 1:
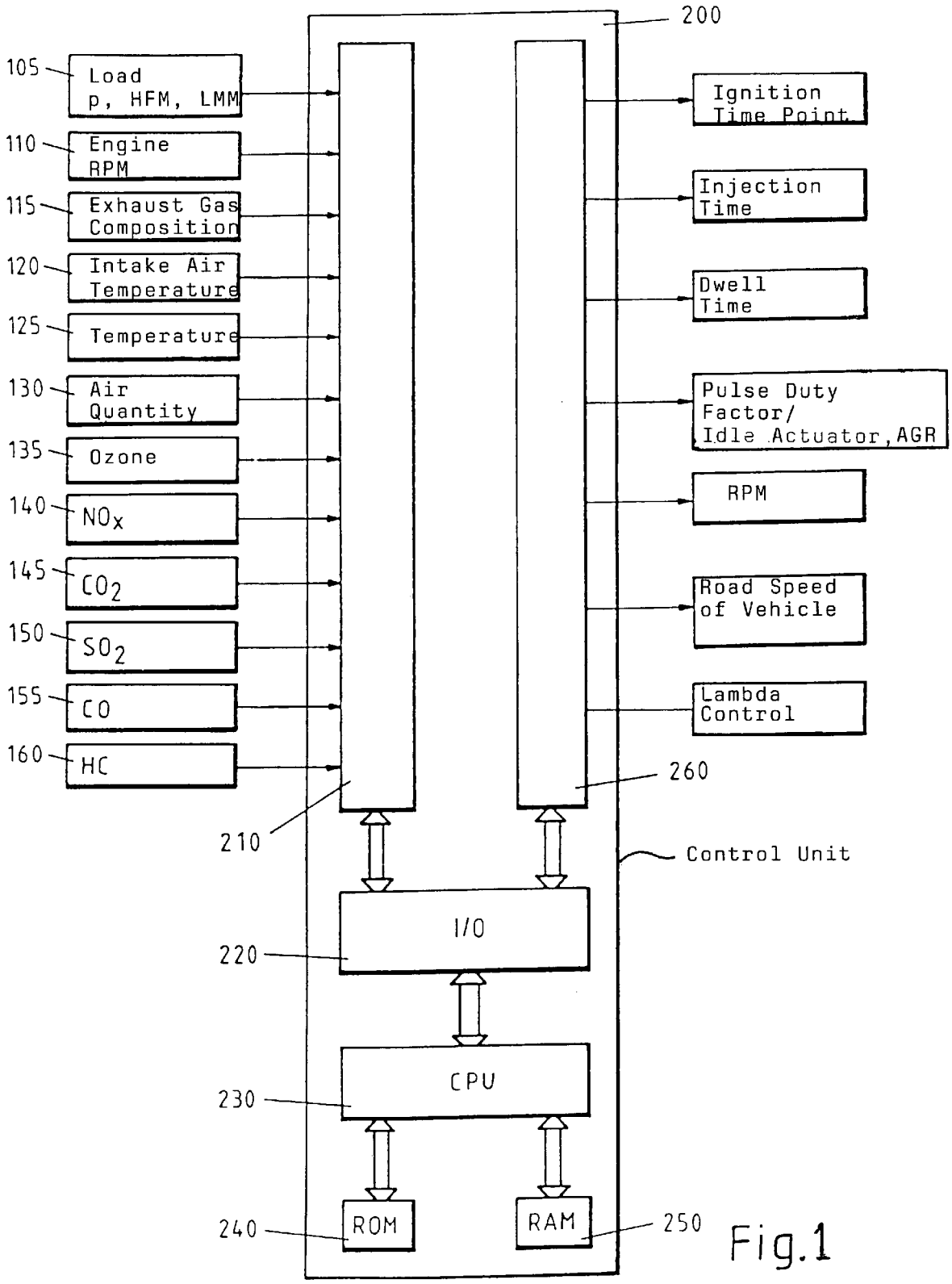

The method for controlling the engine is explained below with reference to the arrangement of the invention shown in FIG. 1 of the drawing.

An arrangement for controlling an internal combustion engine of a vehicle includes sensors for detecting operating data, for example, a load sensor which detects the load signal via the pressure (p), via a hot-wire air mass sensor HFM or an air quantity sensor LMM, an rpm sensor 110, a sensor 115 which detects the exhaust-gas composition, a temperature sensor 125 as well as a sensor 130 which detects the air quantity and, if required, sensors (not shown) which detect still further operating data of the engine.

In addition, further sensors are provided: a sensor 135 which detects the ozone value (that is, the ozone concentration of the ambient air); a sensor 140 which detects the ($NO_x$) value of the ambient air (that is, the nitrogen oxide concentration of the ambient air); a sensor 145 which detects the carbon dioxide ($CO_2$) value (that is, the carbon dioxide concentration of the ambient air); a sensor 150 which detects the sulfur oxide ($SO_2$) value (that is, the sulfur oxide concentration of the ambient air); a sensor 155 which detects the carbon monoxide (CO) value (that is, the carbon monoxide concentration of the ambient air); and, a sensor 160 which detects the hydrocarbon (HC) value (that is, the hydrocarbon concentration of the ambient air). These sensors are connected to analog/digital converters 210 of a control unit 200. The analog/digital converters 210 effect, for example, an analog/digital conversion of the data detected by the sensors. These data are supplied via an input/output (I/O) unit 220 to a central computing unit (CPU) 230. The detected data are processed and evaluated in the central computing unit 230. The central computing unit 230 utilizes for this purpose, in a manner known per se, a read-only memory (ROM) 240 and a read/write memory (RAM) 250.

The processed data are outputted by the central computing unit 230 via the input/output unit 220 to output stages 260 which drive actuating elements. These actuating elements influence the following: the ignition time point and/or the injection time and/or the dwell angle or dwell time and/or the pulse duty factor of the idle actuator and the exhaust-gas return (AGR) and/or the rpm of the engine and/or the road speed of the entire vehicle in dependence upon the values detected by the sensors (105, 110, 115, 120, 125, 130, 135, 140, 145, 150, 155, 160) and processed by the central computing unit 230.

This arrangement affords the advantage compared to known arrangements that a method for controlling an internal combustion engine of a vehicle is made possible wherein the ambient influences are considered and the engine and therefore the entire vehicle can be operated in dependence upon ambient influences. The operating state of the engine and therefore the entire vehicle can be driven in dependence upon ambient influences by the additional detection of the ozone values and/or the nitrogen oxide values and/or the carbon dioxide values. Accordingly, and for an increased ozone concentration detected for example by the sensor 150, the rpm of the engine and/or the road speed of the vehicle is so reduced that fewer toxic substances are outputted by the engine into the ambient.

Correspondingly, and in dependence upon the detected ambient influences, the ignition time point, the injection time, the dwell time, the pulse duty factor of the idle actuator, the lambda control, the exhaust-gas return and the like can be changed.

It is especially advantageous that this influence takes place in parallel to the otherwise detected operating data of the engine. In this way, an especially optimal reduction of toxic exhaust-gas emissions is made possible.

It is understood that the foregoing description is that of the preferred embodiments of the invention and that various changes and modifications may be made thereto without departing from the spirit and scope of the invention as defined in the appended claims.

What is claimed is:

1. A method for controlling an internal combustion engine of a vehicle utilizing a control unit which detects operating data of the engine, the control unit including a computing unit for processing said operating data and the control unit driving actuator means for adjusting the operating state of the engine in dependence upon the detected operating data, the method comprising the steps of:

detecting the concentration of at least one component of the ambient air with sensor means;

processing said concentration in said control unit; and, driving said actuator means in dependence upon said at least one component of said ambient air.

2. The method of claim 1, wherein said sensor means includes at least one of the following: an ozone sensor, a carbon dioxide sensor, a nitrogen oxide sensor, a sulfur dioxide sensor, a carbon monoxide sensor and a hydrocarbon sensor.

3. The method of claim 1, wherein the detected operating data includes at least one of the following: engine rpm, inducted air quantity, engine temperature, composition of the exhaust gas, temperature of the inducted air and the actual load of said engine.

4. The method of claim 3, wherein said actual load of said engine is detected utilizing at least one of the following: a hot-wire air mass sensor, an air quantity sensor and a load sensor which detects pressure (p).

5. The method of claim 1, wherein said actuator means adjusts at least one of the following: ignition time point, injection time, dwell time, pulse duty factor of said idle actuator, exhaust gas return, the lambda control, the rpm of said engine and the road speed of said vehicle.

6. An arrangement for controlling an internal combustion engine, the arrangement comprising:

a plurality of sensors for detecting operating data of said engine;

a control unit for processing and evaluating said operating data;

actuator means connected to said control unit and being provided to adjust the operating state of said engine;

ancillary sensor means for detecting at least one component of the ambient air;

said ancillary sensor means being coupled to said control unit; and, said control unit being adapted to drive said actuator means in dependence upon said data of said ancillary sensor means and said operating data.

7. The arrangement of claim 6, said ancillary sensor means including at least one of the following coupled to said control unit: an ozone sensor, a carbon dioxide sensor, a nitrogen oxide sensor, a sulfur dioxide sensor, a carbon dioxide sensor and a hydrocarbon sensor.

8. The arrangement of claim 6, said control unit including: a source transducer, an output stage, an input/output unit, a control computer unit, a read only memory (ROM) and a read/write memory (RAM).

9. A method for controlling an internal combustion engine of a vehicle equipped with a control unit and actuator means for adjusting the operation of said engine, the control unit including a computing unit for processing operating data of said engine and the control unit driving said actuator means for adjusting the operating state of the engine, the method comprising the steps of:

detecting the operating data of said engine and supplying said operating data to said control unit;

detecting the concentration of at least one component of the ambient air with sensor means and supplying said concentration to said control unit;

conjointly processing said concentration and said operating data in said computer unit; and, driving said actuator means in dependence upon said operating data and said concentration thereby operating said engine in a manner more compatible with the environment.

10. The method of claim 9, wherein said sensor means includes at least one of the following: an ozone sensor, a carbon dioxide sensor, a nitrogen oxide sensor, a sulfur dioxide sensor, a carbon monoxide sensor and a hydrocarbon sensor.

11. The method of claim 9, wherein the detected operating data includes at least one of the following: engine rpm, inducted air quantity, engine temperature, composition of the exhaust gas, temperature of the inducted air and the actual load of said engine.

12. The method of claim 11, wherein said actual load of said engine is detected utilizing at least one of the following: a hot-wire air mass sensor, an air quantity sensor and a load sensor which detects pressure (p).

13. The method of claim 9, wherein said actuator means influences at least one of the following: ignition time point, injection time, dwell time, pulse duty factor of said idle actuator, exhaust gas return, the lambda control, the rpm of said engine and the road speed of said vehicle.

* * * * *